US005448038A

United States Patent [19]

Kim

[11] Patent Number: 5,448,038

[45] Date of Patent: Sep. 5, 1995

[54] APPARATUS FOR MOUNTING A TEMPERATURE SENSOR IN AN ELECTROMAGNETIC INDUCTION HEATING COOKER

[75] Inventor: Dae-Rae Kim, Kyungki-do, Rep. of Korea

[73] Assignee: Samsung Electronics Co., Ltd., Suwon City, Kyungki-do, Rep. of Korea

[21] Appl. No.: 201,022

[22] Filed: Feb. 24, 1994

[30] Foreign Application Priority Data

Feb. 24, 1993 [KR] Rep. of Korea ..... 93-2566 U

[51] Int. Cl.[6] ..... H05B 6/12

[52] U.S. Cl. ..... 219/627; 219/624; 219/667; 219/676; 219/441; 219/494; 374/141

[58] Field of Search ..... 219/622, 623, 624, 627, 219/667, 676, 494, 510, 517, 441, 442, 413, 414; 374/141, 149

[56] References Cited

U.S. PATENT DOCUMENTS

| | | | |
|---|---|---|---|
| 4,065,802 | 12/1977 | Mizukawa et al. | 219/667 |
| 4,092,511 | 5/1978 | Austin | 219/622 |
| 4,351,996 | 9/1982 | Kondo et al. | 219/627 |
| 4,595,814 | 6/1986 | Ogino et al. | 219/624 |
| 5,347,610 | 9/1994 | Lee | 219/517 |

*Primary Examiner*—Philip H. Leung

*Attorney, Agent, or Firm*—Burns, Doane, Swecker & Mathis

[57] ABSTRACT

An electromagnetic induction heating cooker includes a heating coil situated below a cooking plate and mounted on a mounting plate. An attachment assembly is connected to the mounting plate within the center of the coil. The attachment assembly includes a pair of horizontally projecting pieces which overlie the coil and press downwardly thereagainst. A temperature sensor carried by the holder is spring-biased upwardly into contact with the underside of the cooking plate. The holder carries a thermal fuse for shutting off the coil when a sensed temperature exceeds a reference temperature.

15 Claims, 4 Drawing Sheets

FIG. 6
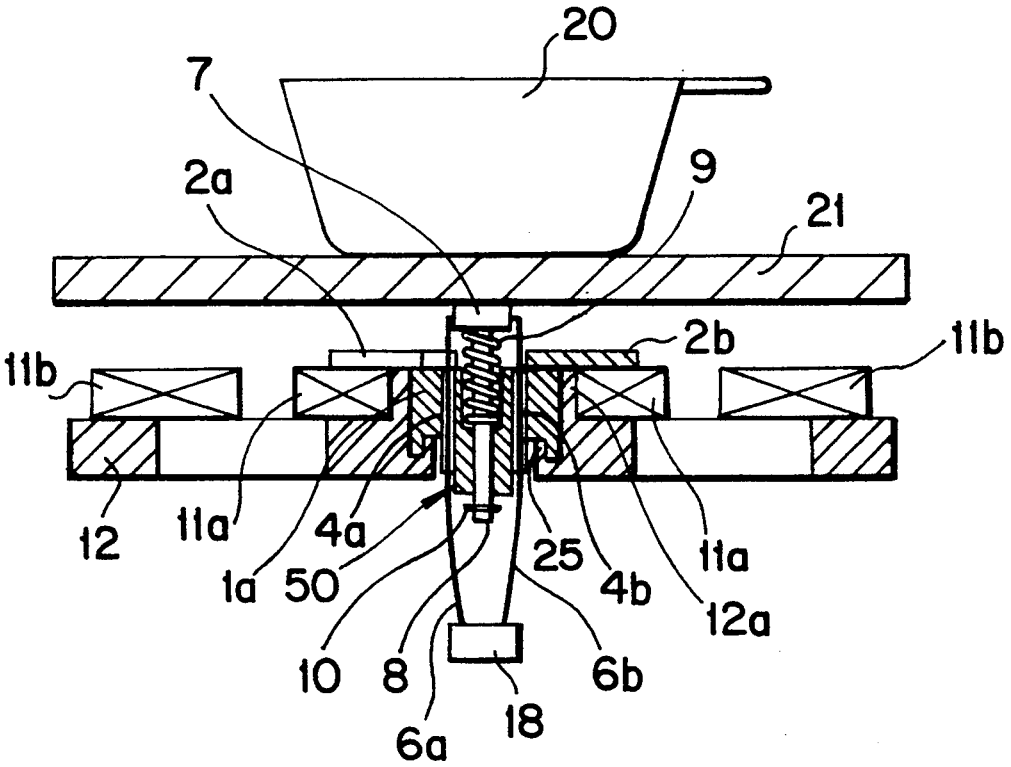
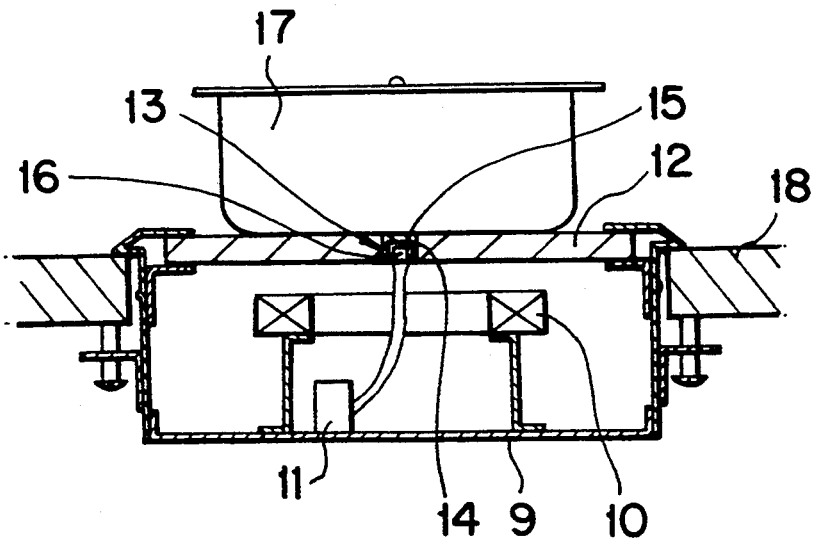
FIG. 7
(PRIOR ART)

APPARATUS FOR MOUNTING A TEMPERATURE SENSOR IN AN ELECTROMAGNETIC INDUCTION HEATING COOKER

BACKGROUND OF THE INVENTION

FIELD OF THE INVENTION

The present invention relates to a cooker, and more particularly to a cooker using a self-induced heating method wherein a thermistor is provided for sensing surface temperature of a cooker pad plate.

A cooker using a self-induced heating method directly heats a metal utensil with a loss of eddy current flowing in the working coil (heating coil) attached to the coil pad plate.

A thermistor type of temperature sensing element is disposed on this cooker in order to control the coil according to the sensed temperatures.

The thermistor is closely disposed to a top plate for supporting the cooking utensils in order to sense temperatures of the utensils more accurately.

For example, a Japanese laid open patent application No. Sho 62(1987)-143387 entitled, "electronically-induced heating cooker" discloses a cooker wherein a heating coil is installed, a top plate is disposed on a top area to support a cooking utensil, and a temperature sensor for sensing a temperature in the cooking utensil is disposed on the top plate.

Depicted in FIG. 7 is a cooker described in Japanse laid open patent application No. Sho 62(1987)-143387, the cooker including a temperature sensor 16 wherein a thermistor 15 is sealed in a conductive metal case 14 that is disposed on a top plate 12, Also depicted in FIG. 7 is a main body 9 of the electronically-induced heating cooker, a heating coil 10, a control unit 11, a recess 13, a cooking utensil 17 and a kitchen counter top 18. In the cooker thus constructed, the thermistor conventionally detects temperature transmitted from the cooking utensil through the top plate, and a control unit of the cooker, once the temperature detected by the temperature sensor rises above a firstly-designated temperature (approximately 320° C.), stops operation of the cooker.

The control unit of the cooker re-operates the cooker once the temperature is below a secondly-designated temperature (approximately 200° C.)

Meanwhile, when an interior of the cooker is overheated due to a malfunctioning of the thermistor and the like, wirings and elements in the interior are sure to be harmed, so that a thermal fuse is inevitably equipped in order to prevent the overheating.

The thermal fuse is rendered open when the interior temperature rises above a predetermined temperature (approximately 130° C.) to thereby cut off the power being inputted to the heating (working) coil.

As mentioned above, in the case of a cooker, one coil pad plate disposed with the working coil cannot carry the thermistor and the thermal fuse at the same time, to thereby necessitate a separate attachment apparatus and complicate the assembly process.

Furthermore, because the working coil is usually attached to the coil pad plate of the cooker by adhesives such as epoxy and the like, the working coil tends to separate from the coil pad plate due to the heat generated by the operation of the cooker.

In order to prevent the separation of the working coil from the plate, a separate support has been used to pressingly fix the working coil.

However, because the support can only press to an outside portion of the cooking coil, there is a problem in that the interior portion of the coil tends to be separated by high heat during cooking.

In order to solve the inside portion of the above problems, a separate apparatus is needed for fixing the working coil, which consequently increases the number of parts to thereby result in difficulty in assembly and reduced manufacturing productivity.

SUMMARY OF THE INVENTION

Accordingly, in order to eliminate the aforesaid problems, it is an object of the present invention to provide an attachment which can easily attach the thermistor and the thermal fuse to the cooker and at the same time, prevent the working coil from becoming dislodged.

In accordance with the present invention for accomplishing the object, there is provided an attachment apparatus for a temperature sensing element of a cooker, the apparatus comprising:

- a working coil being disposed on a top area of a coil pad plate;
- a cooking surface (top plate) on which a cooking utensil can be placed; and
- a holder formed with an insertion hole for fixing a temperature sensor in a cooker disposed with a temperature sensor, and integrally formed with a plurality of coil pressing pieces for pressingly the working coil disposed on the top area of the coil pad plate, the holder being formed with a thermal fuse insertion hole.

BRIEF DESCRIPTION OF THE DRAWINGS

FIG. 6 is a side sectional view depicting the attachment apparatus mounted in a cooker in accordance with the present invention; and FIG. 7 is a sectional view of a conventional electronically-induced heating cooker.

DETAILED DESCRIPTION OF A PREFERRED EMBODIMENT OF THE INVENTION

Hereinafter, the attachment apparatus for a temperature sensing element in a cooker or range according to the present invention will be described in detail with reference to the accompanying drawings.

Figure 1:
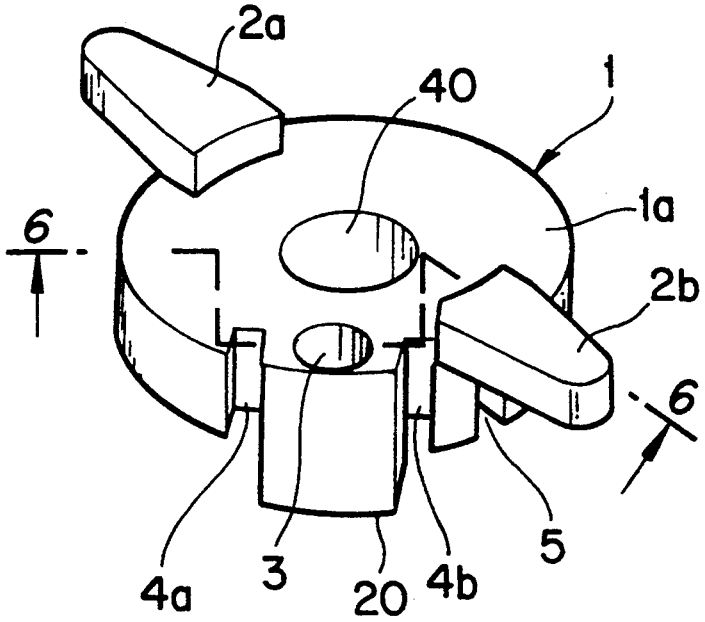
FIG. 1 is a perspective view of a holder of an attachment apparatus of according to the present invention.

In FIG. 1, a holder 1 of an attachment apparatus 50 has a body 1*a* of circular shape with a predetermined thickness.

Reference numerals 2*a* and 2*b* are coil pressing pieces for pressing down on an inner coil portion 11*a* of the working coil 11*a*, 11*b*(see FIGS. 5–6) to have the same closely adhered to the coil pad or coil mounting plate 12.

The holder body 1*a* and coil pressing pieces 2*a* and 2*b* are integrally formed and the pieces 2*a* and 2*b* are formed as radiating from the body 1*a*.

The coil pad plate 12 has an upward protrusion 12*a* area near a periphery of the holder 1.

Meanwhile, a hole 40 is formed in the center of the holder 1, and an insertion hole 3 for mounting a thermistor is formed on eccentrically, in other words, on an area spaced from the center of the holder 1. to one side.

Lead line induction grooves 4*a* and 4*b* incised inwardly from the periphery of the holder body 1*a* are formed on both sides of the insertion hole 3.

The body 1*a* includes a radial extension 20 formed between the lead line induction grooves 4*a* and 4*b*.

Furthermore, a thermal fuse insertion groove 5 incised inwardly from the periphery of the holder body 1 is formed adjacent the lead line induction groove 4*b*.

Figure 2:
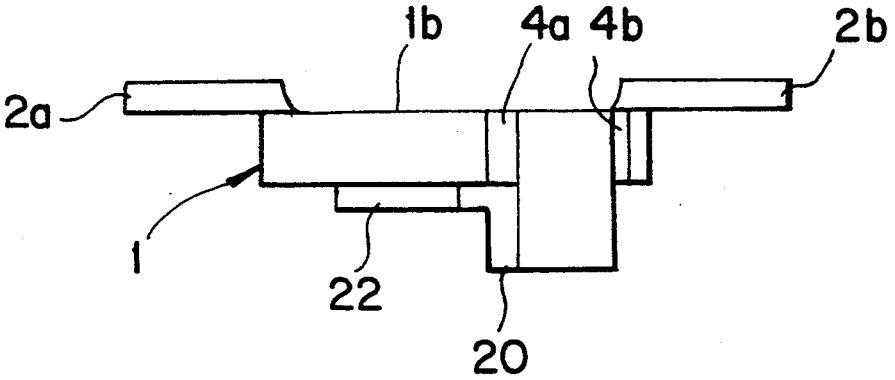
FIG. 2 is a side elevation of the holder of FIG. 1
Figure 3:
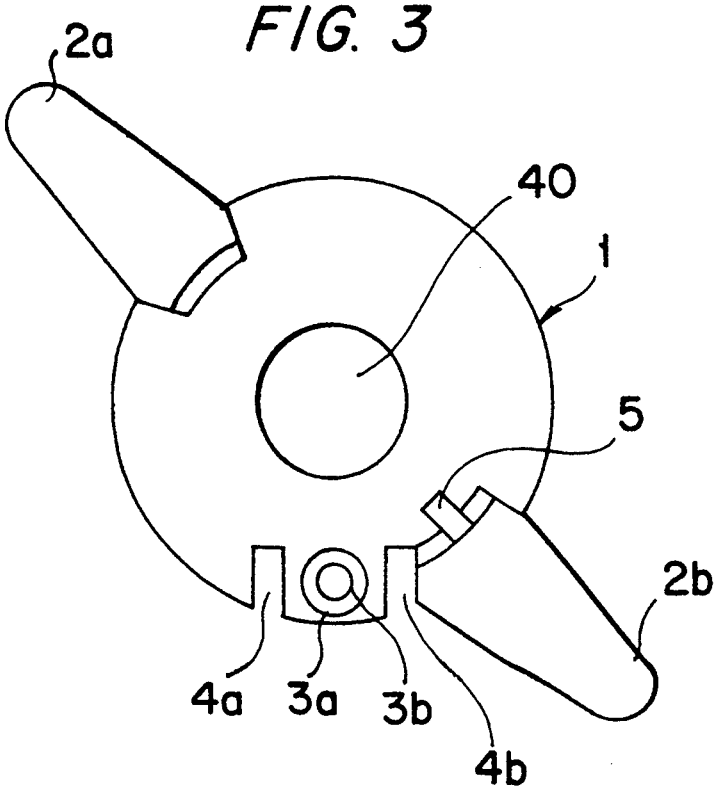
FIG. 3 is a plan view of the holder of FIG. 1

In FIG. 2, reference numeral 22 is a downward protrusion of the body 1*a* having but shorter diameter than that of the upper portion of the body 1*a* and integrally connected to the extension unit 20.

According to FIG. 2, the coil pressing pieces 2*a* and 2*b* are disposed above a top surface 1*b* of the holder body 1*a*, and the extension 20 formed between the lead line induction grooves 4*a* and 4*b* projects downwardly beyond the protrusion 22.

The coil pressing piece 2*b* overlies the thermal fuse insertion groove 5.

Meanwhile, the thermistor is internally disposed in a thermistor bracket 7 having a guide shaft 8, and the insertion hole 3 formed between the lead line induction grooves 4*a* and 4*b* comprises a spring hole 3*a* and a guide shaft insertion hole 3*b* where the guide shaft 8 of the thermistor bracket is inserted.

In other words, the spring insertion hole 3*a* is cylindrically shaped with a predetermined depth from the top side surface 1*b* of the holder 1*a*, and the guide shaft insertion hole 3*b*, also cylindrically shaped but with a shorter diameter than that of the spring insertion hole 3*a*, has a cylindrical shape piercing through a bottom surface of the holder from the center of the spring insertion hole 3*a*.

Figure 4:
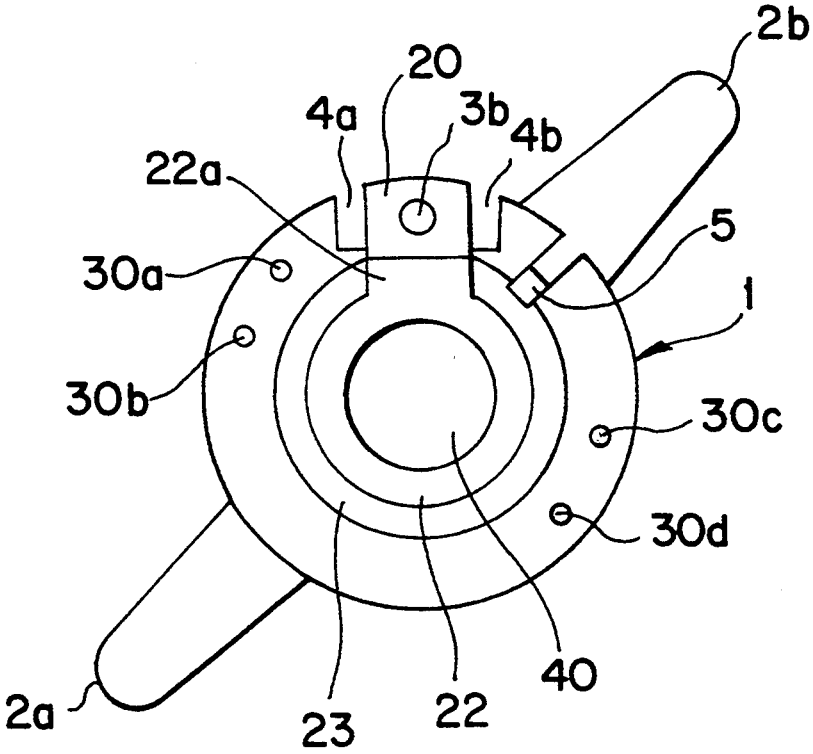
FIG. 4 is a bottom plan view of the holder of FIG. 1

From FIG. 4 it can be seen that the protrusion 22 is formed around the hole 40 disposed in the center of the holder 1 and is extended at 22*a* toward the guide shaft insertion hole 3*b*.

A concave groove 23 is formed around the protrusion 22.

Furthermore, a plurality of fastening holes 30*a*, 30*b* and 30*c* are formed around the concave groove 23.

The plurality of fastening holes 30*a*, 30*b* and 30*c* are intended for receiving fastners fixing the holder 1 to the coil pad plate, and the protrusion 22 and the concave groove 23 are intended for positioning the holder 1, relative to the coil pad plate.

Figure 5:
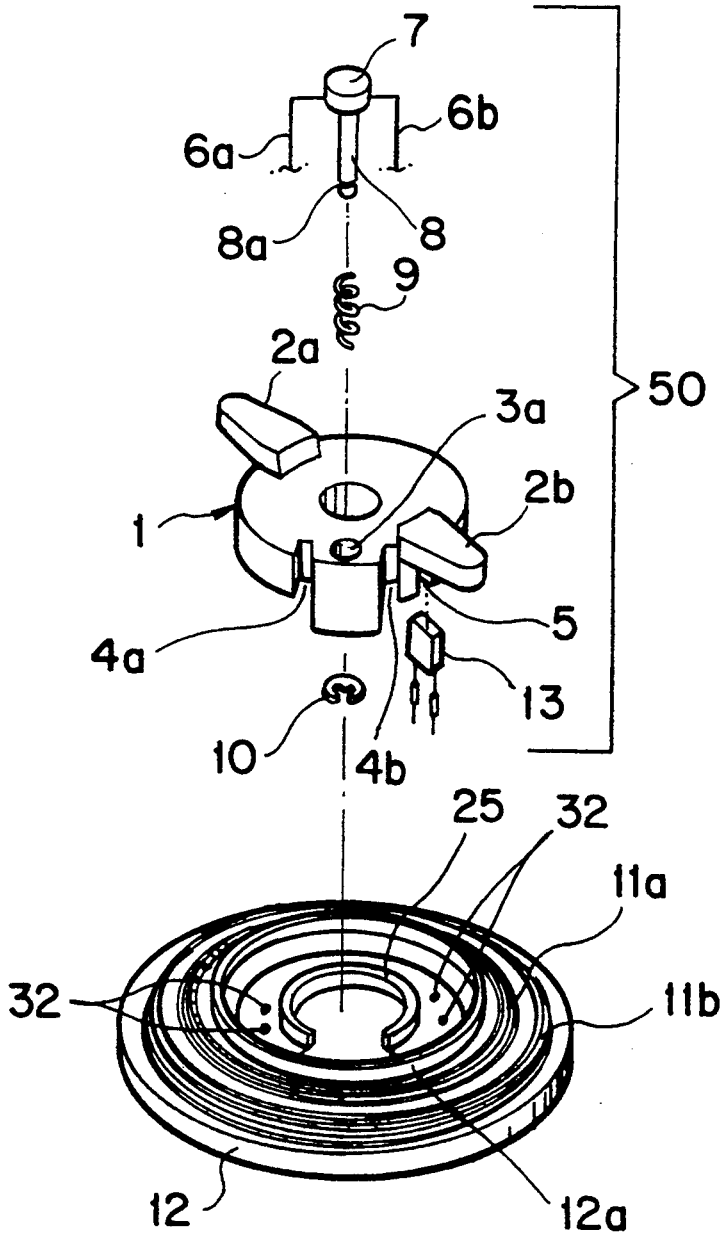
FIG.5 is an exploded perspective view of a cooker and attachment apparatus according to the present invention.

In FIG. 5, a buffer spring 9 is inserted into the spring insertion hole 3*a* formed on the top surface of the holder 1 and surrounds the guide shaft 8 formed on the bottom area of the thermistor bracket 7.

An E-ring 10 is inserted into a ring groove 8*a* formed on the lower end of the guide shaft 8 when the thermistor bracket 7 is inserted into the holder to thereby compress the buffer spring 9.

At this time, lead lines 6*a* and 6*b* of the thermistor internally disposed in the thermistor bracket 7 are positioned in the grooves 4*a* and 4*b* formed on the periphery of the holder 1.

Furthermore, a thermal fuse 13 is disposed in the insertion groove 5 formed on the periphery of the holder 1.

The attachment apparatus 50 thus constructed is inserted into the central area of the coil pad plate 12 where inside and outside working coil portions 11*a* and 11*b* are disposed.

At this time, a protrusion piece 25 formed on the central area of the coil pad plate 12 is inserted into the concave groove 23 formed on the bottom surface of the holder 1.

Furthermore, the attachment apparatus 50 is installed on the coil pad plate by screws (not shown) extending through fastening holes 32 formed on the coil pad plate and fastened to the fastening grooves 30*a*, 30*b* and 30*c* and 30*d* formed on the bottom surface of the holder 1.

FIG. 6 shows the holder in section; taken along the line 6—6 in FIG. 1. In FIG. 6, coil pressing pieces 2*a* and 2*b* are shown as pressing the top area of 11*a* for support of that coil portion.

Meanwhile, as already explained in connection with FIG. 5, a cooking utensil pad plate 21 is disposed over the coil pad plate 12 where the attachment apparatus 50 is joined.

At this time, the thermistor bracket 7 made of such material of good thermal conductivity as aluminum is biased upwards by the buffer spring 9 so that the top end thereof is closely adhered to the lower surface of the cooking utensil pad plate 21.

A cooking utensil 20 is placed on a top area of the cooking plate 21.

A connector 18 is provided for connecting the thermistor to a control circuit of the range.

As seen from the foregoing, the attachment apparatus 50 according to the present invention not only fixedly supports an inner coil portion against being deformed upon being being overheated but also makes it possible for the thermistor and the thermal fuse to be easily installed as a unit.

Accordingly, the working coil can be prevented from being broken away, and the thermistor and the thermal fuse can be easily installed.

The foregoing description and drawings are illustrative and are not to be taken as limiting.

Still other variations and modifications are possible without departing from the spirit and scope of the present invention.

Specifically, in the foregoing description even though, the present invention has only explained about a case where the thermistor is internally disposed in a bracket having a guide shaft, it should be apparent that shapes of the insertion holes formed between the lead line induction grooves of the holder can be varied according to attachment states of the thermistor.

What is claimed is:

1. An electromagnetic induction heating cooker, comprising:

a cooking plate for supporting a cooking utensil;

a coil mounting plate disposed below the cooking plate;

a heating coil mounted on the coil mounting plate;

a holder mounted on the coil mounting plate and including a body and a plurality of coil pressing pieces projecting generally horizontally outwardly from the body, the coil pressing pieces engaging upper portions of the heating coil for pressing the heating coil against the coil mounting plate; and a temperature sensor mounted on the holder for sensing a temperature of a cooking utensil supported on the cooking plate.

2. An electromagnetic induction heating cooker according to claim 1, wherein the holder is mounted in an area surrounded by the heating coil.

3. An electromagnetic heating cooker according to claim 2 further including a biasing member biasing the temperature sensor upwardly against the cooking plate.

4. An electromagnetic heating cooker according to claim 3, wherein the biasing member is a spring.

5. An electromagnetic heating cooker according to claim 4, wherein the body includes an insertion hole, the temperature sensing element and the spring being mounted in the insertion hole.

6. An electromagnetic induction heating cooker according to claim 1, wherein the body includes an insertion hole in which the temperature sensor is mounted, an outer periphery of the body including a pair of grooves disposed on opposite sides of the insertion hole for accommodating electric lead lines connected to the temperature sensor.

7. An electromagnetic induction heating cooker according to claim 6, wherein a thermal safety fuse for shutting off the heating coil is mounted on the holder.

8. An electromagnetic induction heating cooker according to claim 7, wherein an outer periphery of the body includes a groove in which the fuse is disposed.

9. An electromagnetic induction heating cooker according to claim 7 further including a biasing member biasing the temperature sensor upwardly against the cooking plate.

10. An electromagnetic heating cooker according to claim 6 further including a biasing member biasing the temperature sensor upwardly against the cooking plate.

11. An electromagnetic induction heating cooker according to claim 6, wherein the body incudes an insertion hole in which the temperature sensor is mounted, the insertion hole being eccentrically arranged with respect to a center of the holder.

12. An electromagnetic induction heating cooker according to claim 9, wherein the body includes a centrally disposed through-hole formed therein.

13. An attachment apparatus for mounting a temperature sensor to a coil mounting plate of an electromagnetic induction heating cooker, the attachment apparatus comprising:

a holder including a body adapted to be mounted on the coil mounting plate, and a plurality of coil-pressing pieces projecting generally horizontally outwardly from the body for pressing down on a heating coil carried by the coil mounting plate;

a temperature sensor mounted on the body and being biased upwardly by a biasing member; and a thermal safety fuse mounted on the holder for shutting off the heating coil.

14. An attachment apparatus according to claim 13, wherein the biasing member is a spring.

15. An attachment apparatus according to claim 14, wherein the body includes an insertion hole, the temperature sensor and spring being mounted in the insertion hole.

* * * * *